United States Patent [19]

Reinhart

[11] Patent Number: 4,836,858

[45] Date of Patent: Jun. 6, 1989

[54] ULTRASONIC ASSISTED PAINT REMOVAL METHOD

[75] Inventor: Theodore J. Reinhart, Dayton, Ohio

[73] Assignee: The United States of America as represented by the Secretary of the Air Force, Washington, D.C.

[21] Appl. No.: 70,499

[22] Filed: Jul. 7, 1987

Related U.S. Application Data

[62] Division of Ser. No. 902,554, Sep. 2, 1986, abandoned.

[51] Int. Cl.[4] ..... B08B 3/12

[52] U.S. Cl. ..... 134/1; 134/16; 134/38; 51/3; 51/285; 51/332; 51/DIG. 9

[58] Field of Search ..... 51/3, 410, DIG. 9, 285, 51/332; 134/1, 16, 38

[56] References Cited

U.S. PATENT DOCUMENTS

| | | | |
|---|---|---|---|
| 1,043,533 | 11/1902 | Nolan et al. . | |
| 2,758,435 | 8/1956 | Lundell | 55/118 |
| 3,092,946 | 6/1963 | Mathews | 56/24 |
| 3,113,332 | 10/1963 | Kasper | 15/82 |
| 3,159,957 | 12/1964 | Mathews | 56/24 |
| 3,159,958 | 12/1964 | Mathews | 56/24 |
| 3,189,932 | 6/1965 | Daneman | 15/340 |
| 3,295,299 | 1/1967 | Brady et al. | 56/24 |
| 3,623,909 | 11/1971 | Jones | 134/5 |
| 3,678,671 | 7/1972 | Scarnato et al. | 56/505 |
| 3,802,172 | 4/1974 | Mathews | 56/15.8 |
| 3,837,038 | 9/1974 | Kimzey et al. | 15/349 |
| 4,380,478 | 4/1983 | Cooney | 134/38 |
| 4,398,961 | 8/1983 | Mason | 134/19 |
| 4,401,476 | 8/1983 | Klaiber | 134/33 |
| 4,443,271 | 4/1984 | Goerss | 134/34 |
| 4,620,341 | 11/1986 | Rigby | 15/339 |
| 4,705,574 | 11/1987 | Burckhardt et al. | 134/38 |
| 4,724,853 | 2/1988 | Hirose | 134/1 |

OTHER PUBLICATIONS

L. H. Kaplan and S. M. Zimmerman, "Stripping Procedure for High Energy Ion-Bombarded Lasers", IBM Technical Disclosure Bulletin, vol. 21, No. 7, Dec. 1978.

*Primary Examiner*—Asok Pal

*Attorney, Agent, or Firm*—Donald J. Singer; Gerald B. Hollins

[57] ABSTRACT

A paint or other protective coating removal method involving the use of reciprocal motion ultrasonic frequency mechanical energy applied to the coating by a variety of tool and abrasive substrate members in the company of surface preparation agents such as coolant, heating, softening, and/or abrasive agents. The invention is particularly applicable and disclosed in terms of, protective coating removal from aircraft such as is often necessary for replacement or in the reutilization of aircraft with different identification markings. The coating removal method is environmentally and human operator safe in comparison with presently used coating removal methods such as abrasive blasting and chemical solvent removal.

18 Claims, 3 Drawing Sheets

ULTRASONIC ASSISTED PAINT REMOVAL METHOD

RIGHTS OF THE GOVERNMENT

The invention described herein may be manufactured and used by or for the Government of the United States for all governmental purposes without payment of any royalty.

This is a division of application Ser. No. 902,554, filed Sept. 2, 1986, now abandoned.

BACKGROUND OF THE INVENTION

This invention relates to the field of paint or other protective coating removal from structures such as aircraft.

Protective coatings such as paint are used for a variety of functions on vehicles such as aircraft and on a great number of fixed position objects. In such service, the protective coating provides immunity to oxidation or corrosion, provides thermal insulation and shielding, and of course, is a major tool for appearance enhancement and the provision of camouflage and identification.

During the life of a painted or coating protected object, hereinafter referred to typically as an aircraft, the applied coating often requires removal for a variety of reasons, including replacement of worn and weathered coating materials, and changes in the appearance, camouflage or identification of the object such as might occur in the sale of a used U.S. Air Force aircraft to a friendly foreign nation as part of an arms agreement. The removal of present-day coatings from weapons systems is, however, quite labor intensive and often requires the use of highly activated physical and chemical materials.

Coating removal technology has presently, in short, lagged the development of new polymeric resins in the protective coating art. In the earilier period when alkyd primers, alkyd topcoats and acrylic nitrocellulose topcoats were used as aircraft coating materials, removal was readily accomplished with solvent-based strippers which employed, for example, methylene chloride as a major component. However, as coatings have changed from alkyds and nitrocelluloses to epoxies, polyurethanes, and fluoropolymers, such traditional solvent-based strippers have become inefficient or ineffective in coating removal.

Presently used coatings moreover have a useful life expectancy of 5–7 years as a result of their environmental, erosion, and fluid resistance characteristics. These coatings are therefore capable of enduring beyond the first usage period of a weapon system. Such life is in notable contrast with a functional life of about 2 years for the alkyd and acrylic nitrocellulose coatings previously used. The continued polymerizaton and aging of these newer coatings throughout their life and the resulting increased resistance to chemical stripping materially adds to the difficulty of removing these coatings in the inevitable situation where removal is needed.

The chemical industry has provided improved strippers for use with the presently-used coatings by adding activating agents to the traditional solvent stripper solutions. Commonly used activators include phenols, chlorinated phenols, and amine compounds. However, in addition to being unable to effectively and economically remove epoxy and polyurethane coatings, such compounds are found to pose human health risk and therefore become substances that are regulated by environmental protection agencies and occupational safety and health agencies of the federal and state governments. Phenol-activated strippers are the most effective of these groups, but often require as many as five stripping applications. Such strippers are particularly undesirable in that phenol compounds are not biodegradable and therefore can cause especially difficult environmental and water pollution when used insignificant quantities. The addition of hexavalent chromium compounds to these strippers as a corrosion inhibiting agent further restricts the use of such strippers from an environmental viewpoint.

Chemical paint strippers are also inappropriate for the removal of protective coatings from the new nonmetallic organic matrix composite materials now being used in aircraft structures—materials such as an epoxy impregnated fabric of wove graphite filaments. Chemical paint strippers cannot be used for paint removal from such composite materials because of the high risk of the stripper chemically attacking the organic components of the material.

Mechanical paint removal by abrasive blasting is one current alternative to the use of chemical paint stripping. Such abrasive media as crushed corn cobs, glass beads, plastic beads, walnut shells, synthetic diamond dust, garnet particles and dry ice carbon dioxide pellets have been employed in abrasive blasting removal processes. High pressure fluids such as water have also been used in this type of coating removal. All of these techniques have, however, met with such limited success, that a cost-effective and safe arrangement for removing protective coatings, particularly from aircraft structures is yet a pressing need in present-day technology.

The use of plastic beads in abrasive blasting coating removal from aircraft structures and the status of coating removal technology in general is described in a technical report titled "Evaluation of the Effects of a Plastic Bead Paint Removal Process on Properties of Aircraft Structural Materials" published by the Materials Laboratory, Air Force Wright Aeronautical Laboratories, Air Force Systems Command Wright-Patterson Air Force Base, Ohio, 45433, and identified as report number AFWAL-TR-85-4138 dated December 1985. Copies of this report are available from the publishing organization and also from the National Technical Information Service. The contents of the December 1985 AFWAL report is hereby incorporated by reference herein.

As described in the AFWAL December 1985 report, the use of abrasive blasting techniques as an alternate to chemical stripping in metal-skinned and organic matrix composite skinned aircraft raises a number of concerns as to possible undesired side effects of abrasive blasting on an airframe, including the following:

a. Surface roughness and its potential resulting effects on aerodynamic drag;
b. Fatigue properties of the cleaned metal alloys as a result of the induced surface roughness;
c. Removal of protective metal coatings such as aluminum cladding and anodize coatings from aluminum alloys and cadmium plating from steel structure;
d. Effects on the bond strength of aluminum honeycomb and thin skin aluminum metal-to-metal bonded structure.

e. Effects on the physical properties of graphite/epoxy composite materials;
f. Intrusion and consequent effects of the particulate matter on the wear properties of lubricated bearings in the airframe;
g. Thin skin warpage as a result of surface cold working;
h. Effects on fatigue crack growth rate as a result of compressive residual stress on the surface and tensile residual stress in subsurface material;
i. Effects on dye penetrant inspection techniques; and
j. Intrusion of blast partitcles into avionic compartments.

The patent art also discloses the attention of inventors to arrangements for removing paint and other protective coating materials. This attention is evidenced by the patent of J. V. Jones, U.S. Pat. No. 3,623,909, which concerns an electrically heated tool and a method for using the tool in paint removal. Also included in this art are the patents of J. J. Cooney, U.S. Pat. No. 4,380,478, and W. C. Klaiber, U.S. Pat. No. 4,401,476, which each concern arrangements for cleaning paint rollers of the type commonly used for rolling paint onto moderately sized surfaces.

Additionally included in this art is the patent of R. R. Mason, U.S. Pat. No. 4,398,961, which concerns a fuel combustion heated device and method of use thereof for removing old paint. Also included in this art is the patent of W. G. Goerss, U.S. Pat. No. 4,443,271, which concerns an apparatus and method used for cleaning floor grates employing high-pressure water jets.

Further included in this art is the IBM Technical Disclosure Bulletin Vol. 21, No. 7, dated December 1978, entitled "Stripping Procedure for High-Energy and Ion-Bombarded Resists", authored by L. H. Kaplan and S. M. Zimmerman which concerns the removal of resist material layers that have become hard and glossy after high-energy implantation processes and wherein a combination of hot concentrated nitric acid at a temperaure of 80° to 120° C. and ultrasonic agitation are employed. The Kaplan and Zimmerman disclosure bulletin includes at least an inference that the stripping is accomplished in an ultrasonic agitated bath of nitric and phosphoric acids.

It is, of course, well known in the art to employ ultrasonic agitation of a container filled with a solvent or chemical reagent liquid for cleaning purposes. Apparatus of this type has been commercialy available and used, for example, in the cleaning of jewelry and in the cleaning of electronic parts. Ultrasonic energy has also been used for welding and industrial melting attachment arrangements such as in the fabrication of built-up assemblies from plastic component parts.

It may be noted that none of these examples is concerned with the use of ultrasonic energy for the removal of paint or protective coatings from damage-susceptible surfaces such as the exterior of an aircraft.

SUMMARY OF THE INVENTION

In the present invention, mechanical energy of a reciprocating or vibratory nature, with the vibrations occurring in the ultrasonic frequency range, is employed to assist in the removal of protective coatings from aircraft and other objects. The invention contemplates both the use of an excited scraping tool and energized abrasive particles as a delivery means for the ultrasonic energy.

An object of the invention is therefore to provide an ultrasonic energy assisted paint removal arrangement.

Another object of the invention is to provide an ultrasonic energy excited abrasive system for paint removal.

Another object of the invention is to provide an ultrasonic energy assisted coating removal arrangement which is subject to embodiment in the form of a hand-held tool or as a machine or robot-operated tool.

Another object of the invention is to provide an ultrasonic coating removal arrangement wherein assisting media such as coating temperature changing fluids or chemical softening agents are employed.

Another object of the invention is to provide a protective coating removal arrangement which is subject to use in both small scale and large scale environments.

Another object of the invention to provide a protective coating removal arrangement which is suitable for use in combustible or other hazardous environments.

Another object of the invention to provide a coating removal arrangement which is safe for use with respect to the environment and with respect to a human operator.

Additional objects and features of the invention will be understood from the following description and the accompanying drawings.

These and other objects of the invention are achieved by a method for safely removing the paint layer from a physical damage susceptible painted surface including the steps of exciting a shaped edge scraping tool with reciprocal motion ultrasonic frequency kinetic energy, holding the scraping tool edge in pressured contact with the painted surface, and moving the ultrasonic energy excited scraping tool edge into successive areas of the paint layer while maintaining ultrasonic energy force transmitting contact between the tool and the paint layer and sliding contact between the tool and the damage susceptible surface.

DETAILED DESCRIPTION

Concern for the effects of a paint or protective coating removal on the structural integrity and other aspects of modern-day aircraft are very real. In the case of the F-15 aircraft shown in FIG. 1 and the proposed organic matrix composite aircraft to be increasingly employed in future aircraft, abrasive blast coating removal concerns recited in the background section above are, for example, the subject of formal technical investigations.

Figure 1:
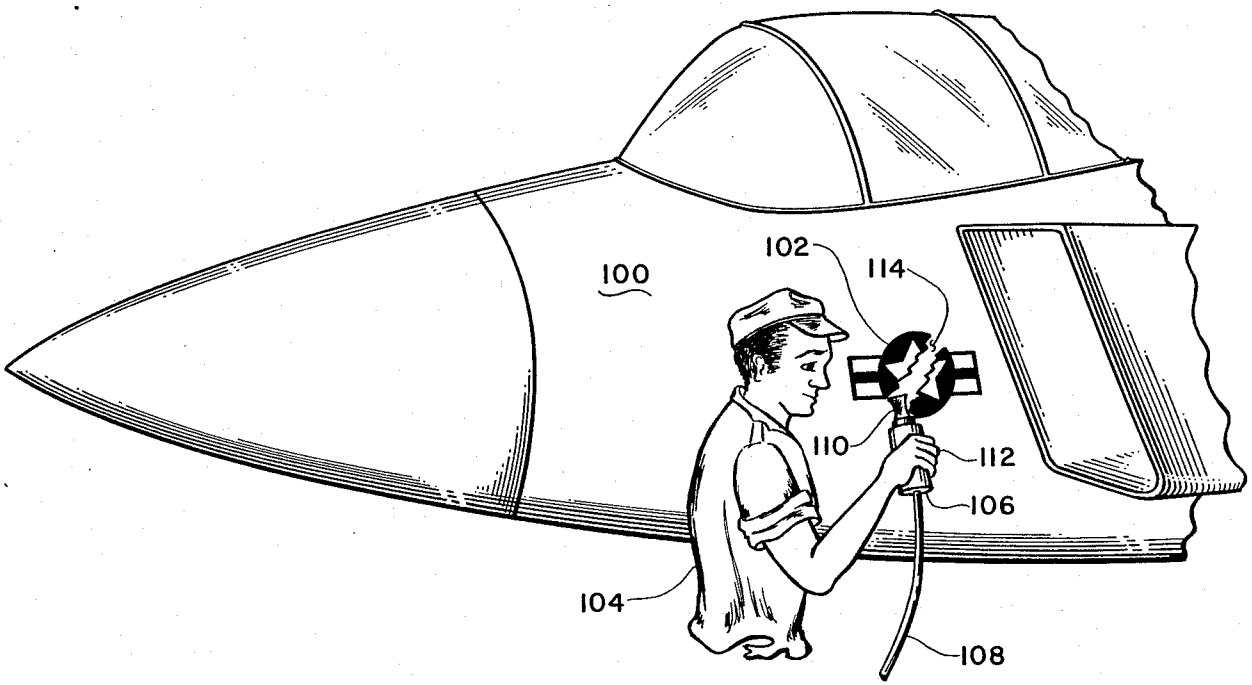
FIG. 1 shows use of apparatus in accordance with the invention to remove a small insignia area portion of the protective coating from an aircraft.
Figure 2:
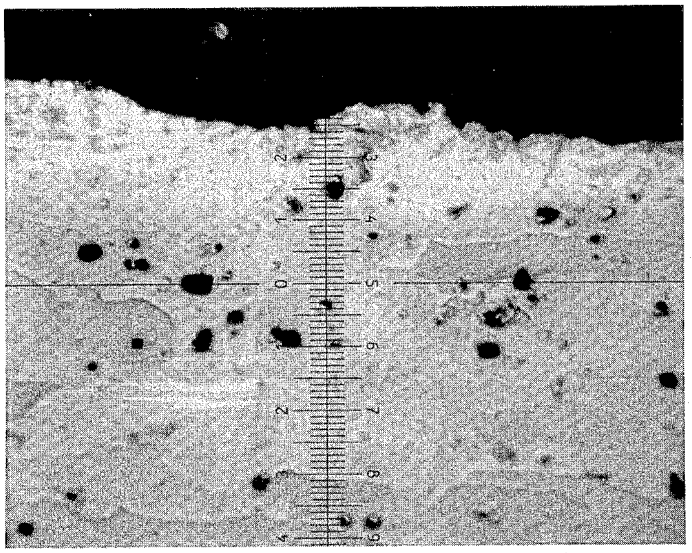
FIG. 2 shows the type of metal surface damage to be expected during an abrasive blast coating removal process.
Figure 3:
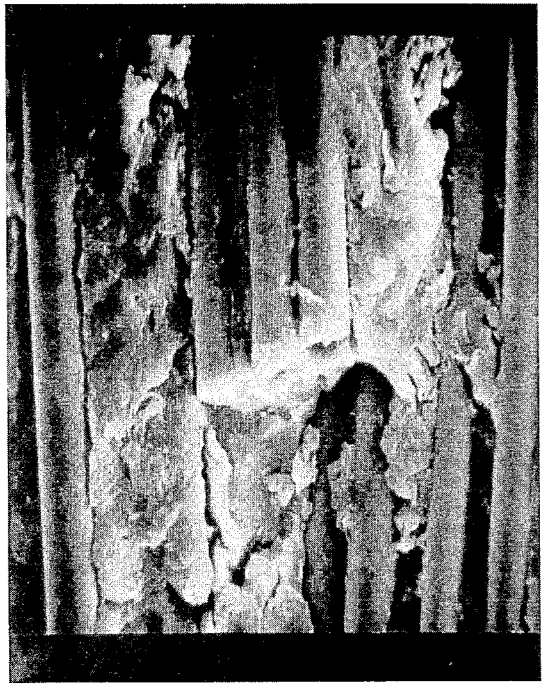
FIG. 3 shows the damage incurred by an organic matrix aircraft composite surface during an abrasive blast protective coating removal.

The microphotograph shown in FIGS. 2 and 3 of the drawings illustrate additional reasons for the detailed consideration of coating removal procedures relating to aircraft. The FIG. 2 microphotograph shows a 800× cross-section of a thin skin metal honeycomb aircraft exterior surface that has been subjected to plastic bead coating removal using a blast pressure of 38 psi. Five coats of paint were removed from the FIG. 2 specimen. The cross-sectioned metal in FIG. 2 is of the type known commercially as Alclad 7075-T6. The FIG. 2 microphotograph illustrates the type of surface damage to be expected during abrasive blast paint removal from a soft metal surface. The incurred damage in FIG. 2 includes severe erosion of the cladding layer, including pitting, thinning, and cracking. FIG. 2 therefore illustrates the irregular and roughened texture surface to be expected with this type of paint removal. In the high-speed, high-stress, high-vibration environment of a FIG. 1 type of aircraft, a surface of the character shown in FIG. 2 is clearly undesirable.

The FIG. 3 photomicrograph illustrates the type of coating removal damage incurred when organic matrix composite materials are used in the skin of an aircraft. The FIG. 3 photomicrograph shows the damage incurred by a surface of this type during one coating removal cycle using a 60 psi abrasive blast with the use of 1000 x magnification. The cutting of matrix filaments and heavy disruption of the epoxy filling between filaments shown in FIG. 3 is an unacceptable compromise of structural integrity for a highly-stressed aircraft component.

The surface damage results illustrated in FIGS. 2 and 3, together with the detailed descriptions and photographic representations of surface damage include the above incorporated-by-reference AFWAL technical report, and the unsuitability of chemical stripping agents for use in modern-day aircraft stripping operations clearly indicates the need for an improved stripping arrangement, an arrangement as shown in FIG. 1 of the drawings, for example.

In FIG. 1, one aircraft currently used by the U.S. Air Force, an F-15 fighter, is shown undergoing a small area protective coating removal procedure wherein one of the aircraft insignia, the cockpit adjacent markers a 102 is being removed. Such removal would be accomplished, for example, if the aircraft were being transferred to a friendly nation, or being refurbished. In the FIG. 1 drawing, a human operator 104 is shown using an ultrasonic kinetic energy tool 110 for removing the insignia 102, as is indicated by the removed area 114.

In the FIG. 1 coating removal arrangement, the tool 110 is excited with ultrasonic reciprocating motion by a transducer 106 held in the operator's hand 112. The tool 110 is and energized by an energy source that is not shown in FIG. 1, but is tethered to the transducer 106 by the flexible conduit 108. Preferably, the transducer 106 is of the electrical energy to mechanical energy type which operates in conjunction with a transistorized or solid-state electronic power converter apparatus connected to the transducer 106 by way of an electrical cable embodiment of the flexible conduit 108. Electrically operated transducers of the FIG. 1 type are commercially available with input energy levels ranging upward from 400 watts. One apparatus of this type is the Sonicator Heat Systems Inc. ultrasonic generator and transducer which is manufactured by Sonicator Systems, Inc. of Newark, N.J. The Sonicator transducer is of the barium titanate type and operates at a power level of about 750 watts delivered to the transducer. The Sonicator apparatus operates at an ultrasonic frequency of 50 kHz. Larger ultrasonic systems, systems operating in the range of 5 to 10 kilowatts of input energy or more are commercially available and are, of course, desirable for uses of the invention involving fast coating removal requirements, extended surfaces of an aircraft or other large area structures. Ultrasonic transducers which are energized by compressed air, pressurized hydraulic fluid or other forms of energy are, of course, considered to be within the scope of the invention. With such larger transducers, mechanically-supported and machine-guided arrangements such as a robotic device which can be programmed for the stripping of a predetermined shape and area, may be desirable.

Figure 4:
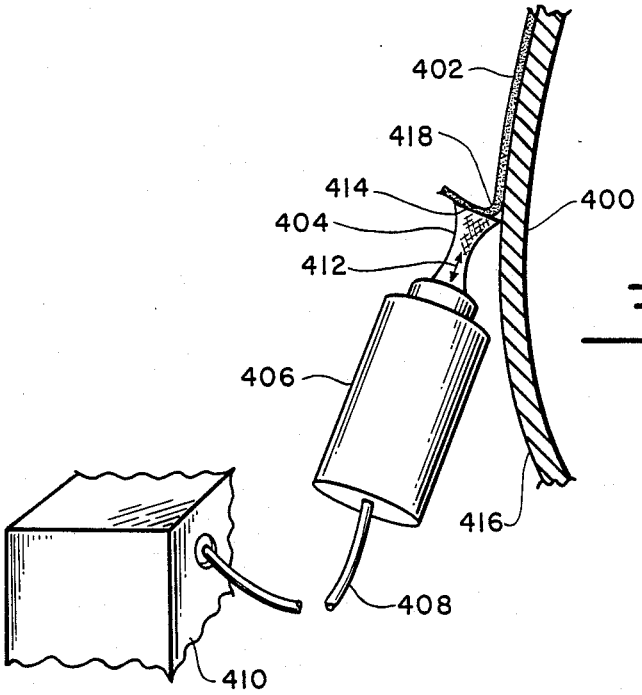
FIG. 4 shows a hand-held tool arrangement of the invention.

FIG. 4 in the drawings provides additional details of a hand-held arrangement of the invention. In FIG. 4, an aluminum exterior surface portion of an aircraft 400 is shown in the process of having a protective coating 402 removed. In the FIG. 4 arrangement a tool 404 which may have a square or blunt edge 414 is energized in the reciprocal or vibratory axial motion fashion indicated at 412. Such motion is intended to achieve both sliding, non-engaging and non-damaging tool movement over the aircraft surface 416, and energy-transferring compression, impacting, shearing, and other destructive engagement with the coating 402 in a contact region 418. The reciprocal or vibratory axial motion 412 in FIG. 4, is provided at ultrasonic vibration frequency by the electrical-to-mechanical energy transducer 406 which may be of the piezoelectric crystal or alternately of the magnetic flux (e.g., moving coil in a magnetic field) type, or of the previously mentioned fluid powered type. In the case of an electrical to mechanical transducer 406, electrical energy of a suitable type is supplied from an energy conversion circuit apparatus 410 by way of a tethering flexible electrical conductor array 408 that connects the conversion circuit apparatus with the transducer 406.

The energy conversion circuit apparatus 410 in the case of an electrical-to-mechanical energy transducer at 406, may be of the type which employs an electronic oscillator circuit coupled to power amplifier transistors and energized by an AC to DC power supply. The apparatus 410 is therefore an energy conversion circuit which converts the typical 60 Hz or 400 Hz electrical supply energy into the voltage, current and waveform desired for operating a selected transducer 406. In the case of a fluid-powered transducer at 406, the conversion apparatus 410 could, for example, include an air compressor, valves, modulators and other fluid devices.

The square or blunt edge 414 for the tool 404 is, of course, but one of many possible shapes which may be employed in a tool which conveys the mechanical energy of the transducer 406 to the protective coating 402. Among the desired properties for the tool 404 and the edge 414 are the following: positive engagement with the protective coating being removed; sufficient mechanical strength to withstand long periods of use; shape convenient for sharpening and reuse; of minimal means to be accelerated by the transducer 406; shaped as needed for compatibility with the surface being cleaned; inclusive of a sliding face for engagement of the aircraft surface 416 with minimal friction, galling, cutting, or other energy transfer; and metallurgical hardness great enough for desirable sharpened edge working life. High carbon steels such as tool steel, carbined steel, or stainless steel or possibly hardened aluminum, are potential metals for use in the tool 404.

Figure 5:
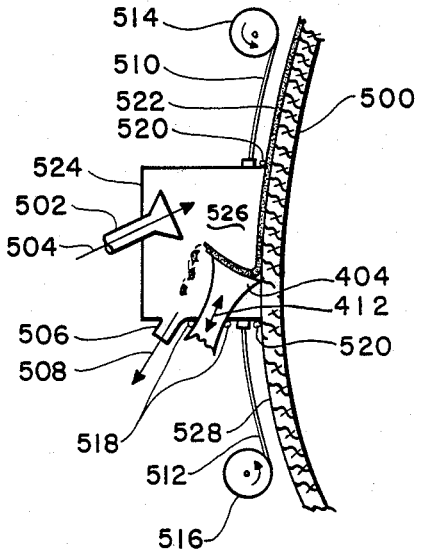
FIG. 5 shows a machine positioned embodiment of the invention and also provides for the addition of assisting agents to the coating removal process.

FIG. 5 in the drawings shows an arrangement of the invention varied from the FIG. 1 and FIG. 4 arrangements in several respects. In FIG. 5, the aircraft skin segment 500 is shown to be of an organic composition, such as the above mentioned organic matrix composite which includes woven fabric which incorporates graphite and epoxy resin as major components. The protective coating used with this matrix composite skin surface, the coating 522, can be of a type similar to that used wih the aluminum skin surface in FIG. 4 or of different composition. The coating types identified earlier herein are applicable to both FIG. 4 and FIG. 5 skin surfaces. The tool 404 and the reciprocal or vibratory axial motion indication 412 in FIG. 5 are similar to the corresponding portions of FIG. 4. A transducer of the type described 406 in FIG. 4 is also presumed in FIG. 5, but is not shown for the sake of drawing simplicity. The transducer employed in FIG. 5 may, of course, be of a different size than the transducer 406 in FIG. 4 in keeping with the other differences in FIG. 5.

The FIG. 5 arrangement of the invention also includes a tool and work surface enclosure 524 which serves to provide an atmosphere indicated at 526 that is conducive to and assisting in removal of the protective coating 522. Communicating with the atmosphere 526, by way of a pair of ports 502 and 506 in the housing 524, is a flow of material 504 capable of assisting the tool 404 in removing the coating 522. The material flow 504 may, for example, include a coolant fluid such as carbon dioxide gas, a heating fluid such as hot air or steam, and/or a supply of abrasive material such as silicon carbide granules. A coating softening agent such as a water-based softener or a chemical solvent softener, may also be used in the flow 504. The residue from the flow 504, together with removed portions of the coating 522 are intended to depart the enclosure 524 by way of the port 506, as is indicated by the exit flow 508. The flows 504 and 508 may, of course, be assisted by the addition of energy as from a pump or other flow-inducing apparatus known in the art.

The size of the enclosure 524 can be used to determine the lead time or soaking time access of the material supplied in the flow 504 to the coating 522 prior to coating engagement by the tool 404. Alternately, it may be desirable to pre-apply some materials of the flow 504 in a separate step or a separate enclosure from that used for the tool 404. Sealing of the enclosure 524 against leakage of the materials of the flow 504 is provided by the resilient members 518 attending the tool 404 and the resilient members 520 located at the junction of the enclosure 524 and the coating 522 and the aircraft surface 528. These resilient members allow movement of the tool 404 and movement of the enclosure 524 to occur while yet maintaining an effective seal of the enclosure 524.

Also included in the FIG. 5 apparatus is a pair of tension members 510 and 512, and a pair of rotatable reels 514 and 516 by which the enclosure 524 can be moved over the surface 528 of the aircraft as the removal of the protective coating 522 ensues. The reels and tension members 514, 516, 510, and 510 may, of course, be motor driven and may comprise part of an automatic feed system which can also be closed-loop in nature and thereby move the tool 404 in response to progression of the coating removal process. The reels and tension members may alternately be embodied in the form of a robotic device of the type used in the automotive industry wherein movement of the tool 404 and the enclosure 524 is accomplished by an extended multiply pivoted manipulative arm. Such arms can, of course, be arranged to respond to force observed by the tool 404, to light reflective differences between the coating 522 and the surface 528 and to other coating removal indicators as are commonly used in industrial controls art. The FIG. 5 apparatus, of course, implies that the transducer which energizes the tool 404 is in some way connected with the housing 524 and moved along with the housing 524 by the tension members 510 and 512.

The use of coolant or heating fluids in the material flow 504, of course, implies a temperature sensitive response by the coating 522, such a response is commonly encountered in the coating art. Many of the present-day coatings, for example, become brittle and subject to ready fracture from energy received from a tool such as the tool 404 upon being chilled to below room temperature. Liquid nitrogen, cooled water solutions, or cooled liquids of the fluorinated hydrocarbon solvent type may therefore also be desirable for use in the flow 504, in addition to the previously recited carbon dioxide. Additionally, heating or chemical reactant fluids may provide a more removal susceptible characteristic to the coating 522.

The shape of the working end of the tool 404 in FIG. 5 may, of course, be varied in accordance with the woven fabric nature of the aircraft skin segment 500 in order to achieve optimum coating removal with minimal skin surface damage. The movement frequency of the tool 404 in FIGS. 4 and 5, the angle of tool application to the aircraft surface, the tool feeding rate and other similar variables are factors which can affect coating removal efficiency and may be fixed after a period of experience with a particular coating removal environment. Persons skilled in the coating removal art will understand that the fixation of all such variables in advance of practical experience with a particular coating situation is undesirable and that some flexibility is desired in arrangements such as shown in FIGS. 4 and 5 to allow for individual situations.

Figure 6:
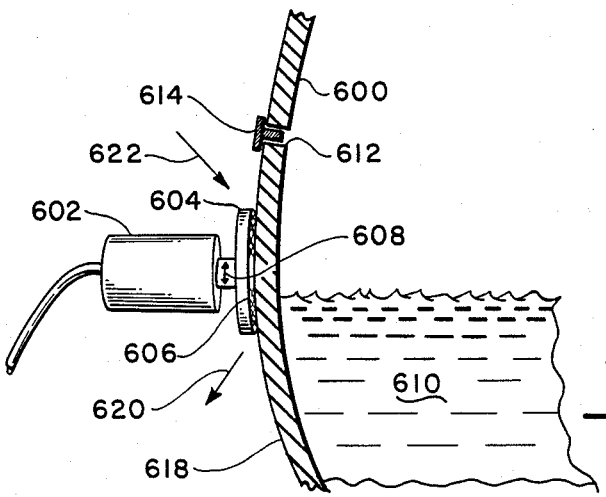
FIG. 6 shows another arrangement of the invention used in an aircraft related hazardous atmosphere location.

FIG. 6 in the drawings shows additional aspects of the invention including use of the coating removal apparatus in a hazardous atmosphere as represented by the proximity of the aircraft fuel 610 and the fuel vent port 612 and vent port cover 614 to the coating removal site. In the FIG. 6 arrangement of the invention, the aircraft skin segment 600 may be a portion of the aircraft wing, for example, wherein the fuel tanks and tank venting arrangements normally reside. Since the described ultrasonic energy transducers may be made free of electrical arcing or the opening and closing of electrical contacts, the FIG. 6 illustrated protective coating removal as well as the removal arrangement shown in FIGS. 1, 4 and 5 herein may be practiced in hazardous, combustion-susceptible atmospheres without danger of igniting fuel vapors or other flammable materials.

The FIG. 6 arrangement of the invention also employs reciprocating ultrasonic energy having movement parallel to the surface 618 of the aircraft, as is indicated at 608. In the FIG. 6 arrangement of the invention, the tool 404 in FIGS. 4 and 5 is replaced with a substrate member 604 on which is disposed an abrasive coating 606. Ultrasonic transducers for use at 602 in FIG. 6 and capable of providing the motion indicated at 608 are, of course, available in the commercial marketplace, and may also be of the piezoelectric crystal or magnetic type, as described above for the transducer 406.

In the FIG. 6 arrangement of the invention, protective coating removal is accomplished by a rubbing, sanding, or polishing action. In such a coating removal arrangement the addition of new abrasive material and the flushing of coating materials or other materials as described for the flow 504 in FIG. 5, and as indicated by the arrows 620 and 622 in FIG. 6 may be desirable.

The FIG. 6 arrangement of the invention may also be used as a supplement to the FIGS. 1, 4 and 5 representations of the invention in order to achieve either polishing or smoothing or final small quantity protective coating removal or initial pre-treatment of the coating to be removed. The FIG. 6 arrangement of the invention may also include an enclosure of the type shown at 524 in FIG. 5 in order to provide either a desired atmosphere 526 or a containment for spent materials.

The described invention therefore comprises the bringing together on a coated surface of ultrasonic energy agitation, in combination with possible abrasive or polishing materials and water or other solution of paint softening agents. Such an arrangement is a possible alternate to the abrasive blasting and chemical removal techniques which are currently employed on aircraft. The described invention may of course, be used with other than aircraft equipment, and may be scaled upward and downard as to energy levels, tool sizes, and utilization times, as is appropriate to the coating area involved. The frequency of the ultrasonic energy used in the invention may be varied in the range of 20 kHz and upward, including presently available commercial equipment which operates in the 50 kHz range. The described protective coating removal arrangements are inherently environmentally and human operator safe, a marked improvement over the presently-used chemical and abrasive blasting removal techniques.

It will be understood by the reader that the terms protective coating, coating, paint and the like are used interchangeably herein without limitation of the invention.

While the apparatus and method herein described constitute a preferred embodiment of the invention, it is to be understood that the invention is not limited to this precise form of apparatus or method, and that changes may be made therein without departing from the scope of the invention, which is defined in the appended claims.

I claim:

1. A method for safely removing the paint layer from a physical damage susceptible painted surface comprising the steps of:

exciting a shaped edge scraping tool with reciprocal motion ultrasonic frequency kinetic energy;

holding said scraping tool edge in pressured contact with said painted surface; and moving said ultrasonic energy excited scraping tool edge into successive areas of said paint layer while maintaining ultrasonic energy force transmitting contact between said tool and said paint layer and sliding contact between said tool and said damage susceptible surface.

2. The method of claim 1 further including the step of changing the hardness of said paint prior to the application of said shaped edge ultrasonic excited tool.

3. The method of claim 2 wherein said changing hardness step includes altering the temperature of said paint layer.

4. The method of claim 2 further including the step of communicating abrasive material with the interface of said paint and said scraping tool.

5. The method of claim 3 wherein said changing hardness step includes exposing said paint layer to heating fluid.

6. The method of claim 3 wherein said changing hardness step includes exposing said paint layer to cooling fluid.

7. The method for removing protecting coating material from the surface of an aircraft comprising the steps of:

pretreating the aircraft coating material with a removal promoting agent;

engaging a small region of the coating with a stress concentrating ultrasonic frequency vibratory motion energized tool member, said engaging including also sliding minimal energy transferring bearing of said tool member upon said aricraft surface;

urging said tool member along said aircraft surface in continuing sliding motion relationship therewith and in persisting ultrasonic motion engaging relationship with the disintegrating and receding edge of said protective coating; and removing the disintegrated and loosened coating material from the field of coating engagement.

8. The method of claim 7 wherein said pretreating includes exposing the protective coating to a flow of pretreatment fluid.

9. The method of claim 8 wherein said pretreating step includes changing the hardness of said coating.

10. The method of claim 9 wherein said pretreating step includes changing the temperature of said coating.

11. The method of claim 10 wherein said pretreating step includes cooling the protecting coating.

12. The method of claim 10 wherein said pretreating step includes heating the protecting coating.

13. The method of claim 8 wherein said pretreatment fluid is a chemical reactant.

14. The method of claim 8 wherein said pretreatment step and said removing step employ the same fluid flow.

15. The method of claim 7 further including the step of supplying abrasive material to the field of coating engagement.

16. The method of claim 7 wherein said urging step includes moving said tool member and the locus of said engaging with mechanical movement apparatus.

17. The method for abrasive removal of protective coating material from the surface of an aircraft comprising the steps of:

engaging a small region of the coating with ultrasonic frequency vibrating abrading material, said engagement including applying a force normal to the aircraft surface and urging said abrading material and said coating into intimate contact by way of said normal force;

moving the region of abrading engagement over said aircraft surface in response to accomplished abrading;

dispersing spent abrading material and removed coating material from the field of said engaging with a flowing fluid.

18. The method of claim 17 further including the step of adding additional abrading material during the course of said engaging step.

* * * * *

UNITED STATES PATENT OFFICE
CERTIFICATE OF CORRECTION

Patent No. 4,836,858 Dated June 6, 1989

Inventor(s) Theodore J. Reinhart

It is certified that error appears in the above-identified patent and that said Letters Patent is hereby corrected as shown below:

Col 1, line 30, after "object" should be a dash "-".
Col 1, line 39, "earilier" should be "earlier".
Col 2, line 1, before "therefore" should be "have".
Col 2, line 9, "insignificant" should be "in significant".
Col 2, line 44, after "Command" should be a comma ",".
Col 5, line 42, line should read --of the aircraft markers, a cockpit adjacent insignia--.
Col 5, line 52, "and" should be deleted.
Col 6, line 5, after "requirements," the remainder of the sentence should read --larger surfaces of an aircraft or other extended area structures.--
Col 6, line 60, "means" should be "mass".
Col 7, line 6, second occurrence of "which" should be "and".
Col 7, line 10, "wih" should be "with".
Col 10, claim 7, line 10, "aricraft" should be "aircraft".

Signed and Sealed this

Twenty-ninth Day of January, 1991

*Attest:*

HARRY F. MANBECK, JR.

*Attesting Officer*

*Commissioner of Patents and Trademarks*